United States Patent [19]

Zehender

[11] Patent Number: 4,881,583

[45] Date of Patent: Nov. 21, 1989

[54] WOODWORKING MACHINE

[75] Inventor: Jürgen Zehender, Huettlingen, Fed. Rep. of Germany

[73] Assignee: Okoma Oberkochener Machinen GmbH, Oberkochen, Fed. Rep. of Germany

[21] Appl. No.: 197,187

[22] Filed: May 23, 1988

[30] Foreign Application Priority Data

May 23, 1987 [DE] Fed. Rep. of Germany ..... 3717411
Apr. 26, 1988 [DE] Fed. Rep. of Germany ..... 3814018

[51] Int. Cl.[4] ..... B27M 1/08

[52] U.S. Cl. ..... 144/3 R; 144/82; 144/198 R; 144/203; 144/204; 144/367

[58] Field of Search ..... 144/2 R, 3 R, 82, 198, 144/203, 204

[56] References Cited

U.S. PATENT DOCUMENTS 4,331,191 5/1982 Buttner ..... 144/3 R

*Primary Examiner*—W. Donald Bray
*Attorney, Agent, or Firm*—Wells & White

[57] ABSTRACT

A woodworking machine for cutting tenons and mortises in woods, especially window woods, and comprising at least one tenoning-and-mortising unit and at least one lengthwise profiling unit, where a length-cutting device and a roller table are associated with the tenoning-and-mortising unit, where further a transverse conveyor is provided to move the window wood into an operational position wherein the second end of the window wood shall be provided with tenon and mortise and also comprising a transfer system to transfer the window wood equipped at both ends with tenons and mortises to the lengthwise profiling equipment, said machine being designed in such a manner that its manufacture is economical and its construction is compact.

For that purpose the invention provides a single tenoning-and-mortising unit which together with its associated length-cutting device, its bearing, its hood and the like can be entirely lowered below the surfaces of the work and roller table, where the tenoning-and-mortising unit below the work and roller table can be moved from a first position wherein the first end of the window wood is processed into a second position where the second end is processed, this window wood in order to be processed at its second end being moved oppositely to the previous direction of advance along the offset tenoning-and-mortising unit of which the processing wides face each other in the two said positions, the window wood being cut to length following the processing of the first end and then being displaced.

12 Claims, 5 Drawing Sheets

WOODWORKING MACHINE

The invention concerns a woodworking machine for cutting tenons and mortises and for lengthwise profiling, in particular of window frames, comprising at least one tenoning-and-mortising unit and at least one unit for lengthwise profiling, a roller table and a length-cutting device being associated with the unit for tenoning and mortising, furthermore a cross-conveyor being provided to move the window frames into a work position where the second end of the window frame is equipped with tenon and mortise and where there is a transfer device to transfer the window frame equipped at both ends with tenons and mortises to the lengthwise profiling unit.

In known apparatus of this kind, first the window frame is cut to length at one end, whereupon it is provided at this end by a downstream tenoning-and mortising unit with tenon and mortise. Next the window frame is displaced longitudinally until its second end arrives at another length-cutting device, preferably a saw, and in the vincinity of a second tenoning and mortising unit, whereupon this window frame is moved transversely to its longitudinal direction and is provided at its second end with tenon and mortise. Thereupon the window frame, which now is equipped with tenons and mortises at both ends, is transferred at a right angle into the profiling apparatus.

This known apparatus incurs the drawback that a separate tenoning and morising unit with its complete and costly set of tools is required for each end of the winddow frame. Moreover this known apparatus is fairly bulky.

SUMMARY OF THE INVENTION

Therefore it is the object of the present invention to so design a woodworking machine of the initially cited kind that in addition to being compact it can also be constructed economically.

This problem is solved by the present invention in that a single tenon-and-mortise cutting unit is provided which, including the associated length-cutting device, its bearing, its hood, and the like, can be entirely lowered below the surfaces of the work and roller table, the tenon-and-mortise cutting unit below the work adn roller table being moved between a first position where the first end of the window frame is processed and a second position for processing the second end of the window frame, where, in order to process that second end, the window wood is made to pass in reverse opposite the previous advance along the offset tenoning and mortising unit of which the workpiece sides face each other in both positions, the window frame following processing of the first end being cut to size and displced.

This apparatus makes it possible that the very costly second tool set, which is required in the known apparatus, shall be eliminated. The design thereby becomes quitet compact. In addition to saving operating time, this advantage also applies with respect to other known machinery with turn features.

Another advanage of the apparatus of the present invention is that the initial lengthwise alignment of the window frame remains fixed during the entire processing because the frame is made to move in reverse into its previous position for the workpiece on the second end. Again, apparatus size is reduced thereby.

Another advantage is that only a single roller table is required—contrary to the case of the known apparatus—on which the window frame is clampable in two different positions depending on the length control, whereby another contribution is made toward compactness of components and assembly space.

Advantageously again, the units shall be so mounted for lengthwise profiling that the longitudinally profiled window frame leaves the machine again at its entry side, whereby the operator stationed there can watch both the entry and the exit of the window frame.

Preferably the two positions of the tenon-and-mortise cutting unit are located in a vertical plane parallel to the length of the window frames.

Appropriately a length-cutting device is associated with each of the two positions of the tenoning-and-mortising unit, where this device also can be lowered but otherwise is fixed. Nevertheless a single length-cutting device also may be used, which in that case is jointly displaced.

Guide rods with circular cross-sections can be used for the transverse displacement and also the height adjustment of the tenoning-and-mortising unit, which cannot be translated but is height-adjustable, along the, whereas the transverse displacement of the entire unit together with its height-adjustment guide takes place on the guide rods orthogonal thereto.

A varied embodimen consists of two tenoning-and-mortising units which are height-adjustable but otherwise fixedd, whereby the window frame being processed can move over them also. Mahcinery of this type is exceedingly compact, but on the other hand the above described saving in tools cannot be carried out in this embodiment mode.

The principle of the above woodworking machine can be implemented in especially advantageous manner also as regards apparatus for the bilateral lengthwise profiling of rectangular wooden workpieces, iin particularl window frames, the particular window frame being made to pass by one of its longitudinal sides along at least one first lengthwise profiling bit and thereupon by its other longitudinal side laong at least another lengthwise profiling bit.

The present invention provides for such apparatus that the particular lengthwise profiling spindle can be lowered together with the tool set mounted on it and its power drive, bearing, hood and the like entirely below the surface of the associated dwork table, the lengthwise profiling spindle being displaceable while underneath the work table from a first position wherein the first longitudinal side of the window frame can be profiled lengthwise, into a second position for the lengthwise profiling of the second longitudinal side of the window frame, this window frame being displaced in reverse to the previous direction of advance along the offset lengthwise prófiling spindle when being processed on its second longitudinal side, the spindle's working sides facing each other in the two positions.

This system makes it possible to halve the number of conventionally required lengthwise profiling spindles and the number of associated tools, so that again substantive costs are eliminated. Moreover the length profiling apparatus is very compact.

Furthermore, the processing rate is increased because the window frame to be worked requires being moved merely to and fro in parallel longitudinal ddirections, that is, it need not be rotated.

Another advantage of the lengthwise profiling apparatus of the invention is that following its lengthwise profiling, the bilaterally profiled window frame will return to its initial position, whereby the operator need not change his place, in other words, a second operator to receive the finished frames is not needed either.

The lengthwise profiling apparatus of the invention can operate with a single lengthwise profiling spindle; however several lengthwise profiling spindles also can be used in known manner, which would have to be all displaceable in the way of the invention underneath the work table.

The lengthwise profiling apparatus of the invention is applicable to a known woodworking machine comprising one or more tenoning-and-mortising spindles cutting tenons and mortises into the ends of the window frame facing them, the window frame now fitted with tenon and mortise being transferred at right angle to the lengthwise profiling apparatus. This apparatus can be designed as described above.

Because the bilaterally profiled window frame processed in such apparatus will leave it in the angular zone between the lengthwise profiling apparatus on one hand and the tenoning-and-mortising units on the other, this frame appropriately is moved back along a second plane by a conveyor, which may be a roller table, into its feed position in front of the tenoning-and-mortising units.

However the use of this apparatus assumes that before the processing, the window frame also was provided with tenon and mortise at the other end away from the tenoning-and-mortising spindles.

The lengthwise profiling apparatus of the invention is used to special advantage when comprising, as above, at least one tenoning-and-mortising spindle that together with its power drive, its hood and all remaining accessories can be moved underneath and a work and roller table from a first into a second position, the processing sides of the tenoning-and-mortising spindle being mutually opposite in these two positions.

In such apparatus, after two passes, the window frame has been provided with tenons and mortises and thereupon can be moved toward the lengthwise profiling apparatus for the longitudinal profiling of its two sides. Accordingly the tenoning and mortising as well as the lengthwise profiling take place in immediate sequences. The above cited advantages for the lengthwise profiling procedure are retained in full.

BRIEF DESCRIPTION OF THE DRAWINGS

The present invention is discussed below more comprehensively in relation to the illustrative embodiments shown in the drawings.

DESCRIPTION OF THE PREFERRED EMBODIMENTS

Figure 1:
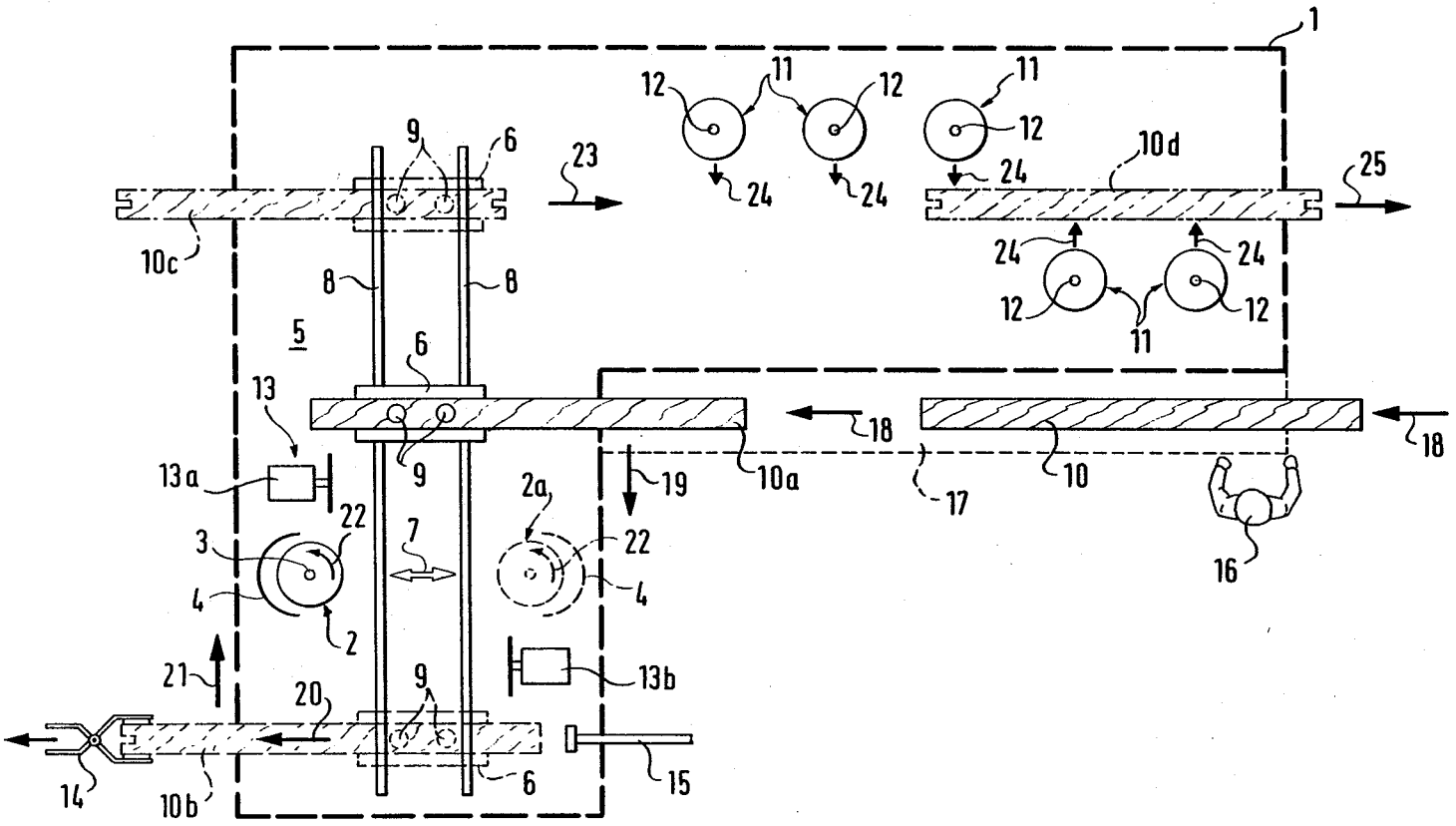
FIG. 1 is a schematic of one embodiment of the woodworking machine of the invention.

As shown in FIG. 1, the woodworking machine 1 shown by the dashed line enclosure comprises a tenon-and-mortise cutting unit 2 with a schematic tenoning and mortising spindle 3 and also with a schematic hood 4, this unit together with its accessories being movable below the surfaces of a work table 5 or a roller table 6. When the tenoning-and-mortising unit 2 is hooded, it can be displaced below the the work or roller table in the direction of the double arrow 7 and it may assume the positions shown in solid or dashed lines. The roller table 6 is displaceable in known manner along guides 8 and is provided with schematic clamp means 9 that tighten the window frame 10 to the roller table 6.

One length-determining means 13 in the form of a saw is associated with each position of the tenoning-and-mortising unit 2 of this embodiment.

The woodworking machine 1 furthermore comprises several units 11 to profile the window frame in the longitudinal direction by means of lengthwise profiling spindles 12 processing the window frame 10, after it has been provided with tenons and mortises at both ends, with a longitudinal profile.

A transverse conveyor is used to control the lengths and it may be deseigned as a gripper 14 or also as a pushrod 15, which displaces the window frame 10 along the roller table 6 until its unprocessed end has been cut to size and can be provided with tenon and mortise.

The apparatus operates as follows:

An operataor 16 or a conveyor means moves the window frame 10 to be processed onto a conveyor 17, for instance of the roller type, which transports this frame in the direction of the arrows 18 onto the roller table 6 where it is tightened by means of the clamps 9. Now the frame assumes the position **10*a*. Then the frame is moved perpendicularly to its prior direction in the sense of arrow 19, its end facing the first cut-off saw 13*a* being cut off by that saw and then being provided with tenon and mortise by the tenoning-and-mortising unit 2. No tenoning-and-mortising unit is present at position 2*a* and the second lengh cut-off saw 13*b* has been lowered below the surface of the work table 5 or roller table 6**, whereby the window frame already processed at one end can move over both these positions.

Thereupon the winddow frame arrives at position **10*b* where its processed end is seized by the gripper 14 and it is displaced in the direction of arrow 20 by an amount corresponding to the predetermined length. Following new tightening by the clamps 9, the roller table 6 together with the window frame moves in the opposite direction, that is in the sense of the arrow 21, while beforehand, that is during the length control procedure, the cut-off saw 13*b* as lifted into the operational position above the table surface and the tenoning-and-mortising unit 2 was offset into the position 2** and there also was moved into the operational position.

During the back motion in the direction of the arrow 21, the second end of the window frame 10 is cut off to length by the saw **13*b* and thereupon it is provided with tenon and mortise by the same tenoning-and-mortising unit 2. The direction of rotation indicated by arrow 22 carried out by the tenoning-and-mortising unit 3** for milling in the opposite direction will be the same, the processing sides of the unit facing each other in the two positions, as shown. Accordingly, when offsetting the tenoning-and-mortising unit, it is no longer necessary to reverse the direction of rotation.

The window frame now is equipped at both ends with tenons and mortises and arrives at position 10c from where it is moved in the direction of the arrow 23 to the lengthwise profiling equipment 11. After the lengthwise profiling is completed, the window frame is removed from the machine in the direction of the arrow 25, the discharge location being directly near the feed side, whereby the operataor 16 can monitor both the input and the removal of the window frame without leaving his location.

The invention also covers variations in its woodworking machine. Illustratively two tenoning-and-mortising units 2 may be present, which are stationary except for being height-adjustable, whereby the processed window frame can move over them. Both embodiment modes allow using a single length cut-off saw 13, in which event this saw must be offset below the table the way the mortising-and-tenoning unit 2 is, and which may then have to be rotated by 180°.

Figure 2:
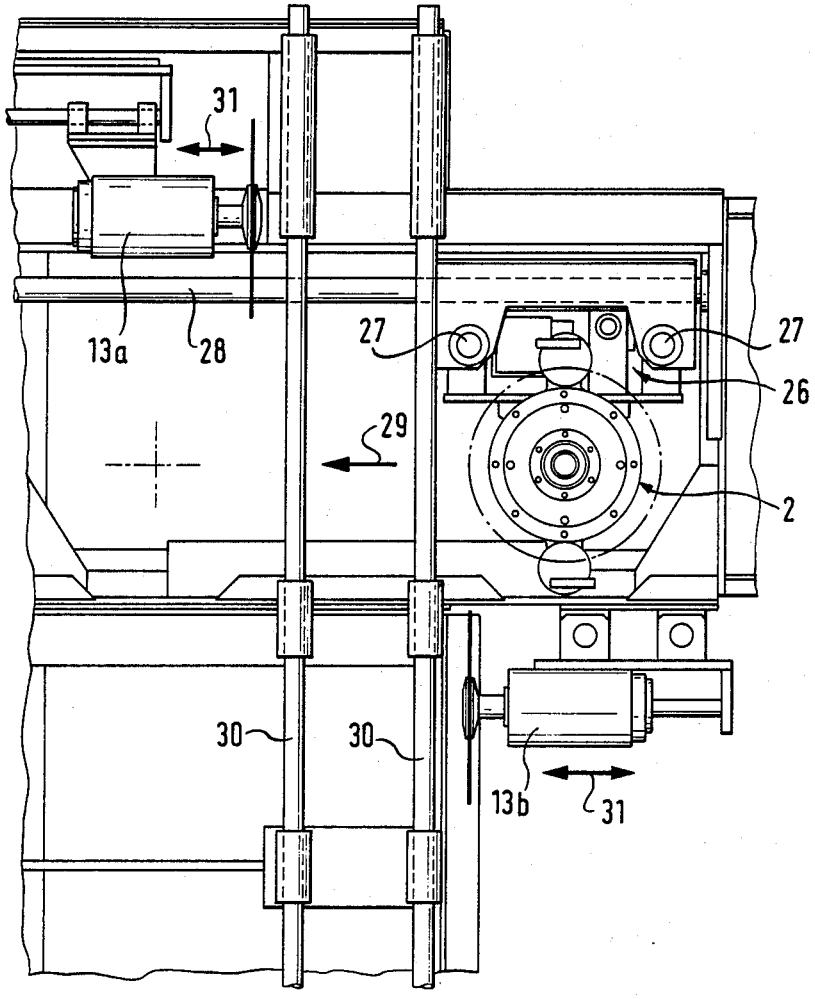
FIG. 2 is a cutaway on an enlarged scale and shows further details of the woodworking machine.

FIG. 2 shows further details of the machine of the invention. It illustrates a fastening system 26 for the tenoning-and-mortising unit 2 which is height-adjustable along guide rods 27 having circular cross-sections. The entire tenoning-and-mortising unit 2 inclusive its fastening system is transversely displaceable along guide rods 28 of which only one is shown in FIG. 2, in the direction of the arrow 29, and rods 28 alsos may be of circular-cross-sections. Guide rods 30 guiding the roller table l6 extend above the hooded tenoning-and-mortising unit 2 and thereby above the guides 28.

Furthermore, and as shown, length cutting saws 13*a* and 13*b* also may be mounted to be displaceable transversely to the direction of the arrows 31.

The apparatus of the invention is especially well suited to simultaneously process several wiindow woods of the same length, in particular for the pairwise processing of window frames.

The cutoff saws 13*a* and 13*b* however may be removed from the path of the workpiece in being pivoted upward instead of being lowered. Then both or only one of the two cutoff saws can then be pivoted upward.

An especially appropriate arrangement is to pivot downward the length cutting saw 13*a* which is first in the operational sequence, thereby creating a corresponding opening in the work table plate, while the second cutoff saw 13*b* is pivoted upward. The upward pivoting motion requires no opening in the table plate, or at least no unduly large opening, and thereby this design is especially well suited for operations in which the dropped wastes are fairly large. However this is the case when finally cutting the workpiece off to length in accordance with the length control.

Figure 3:
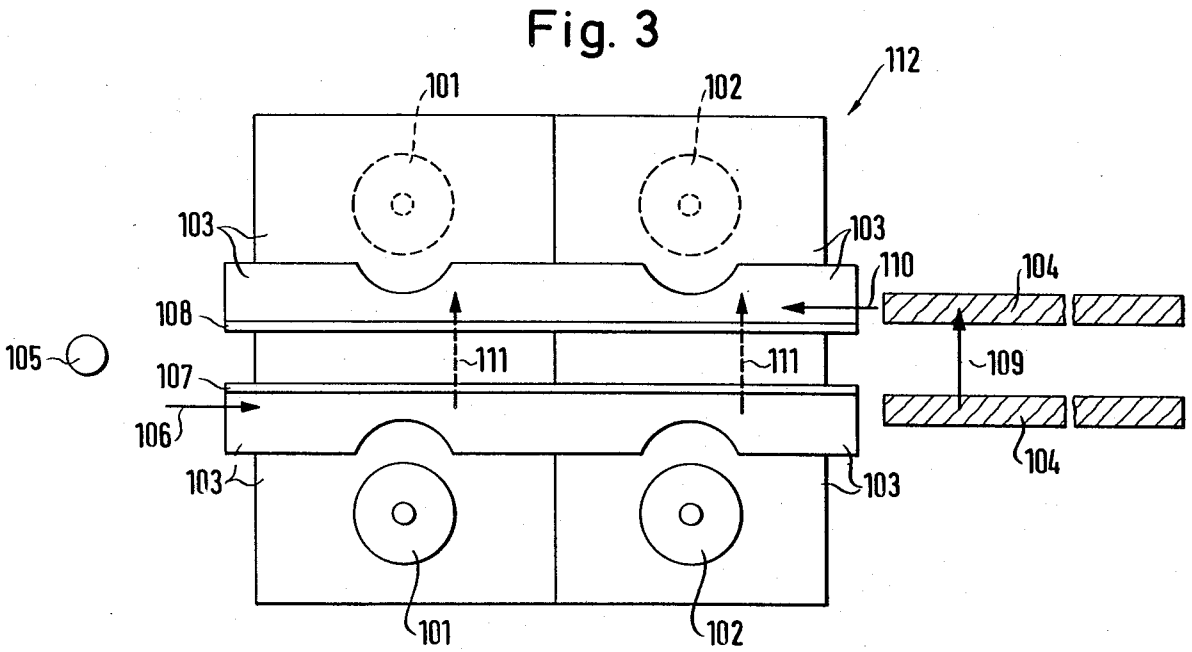
FIG. 3 is a schematic of an embodiment of the lengthwise profiling apparatus of the invention.
Figure 4:
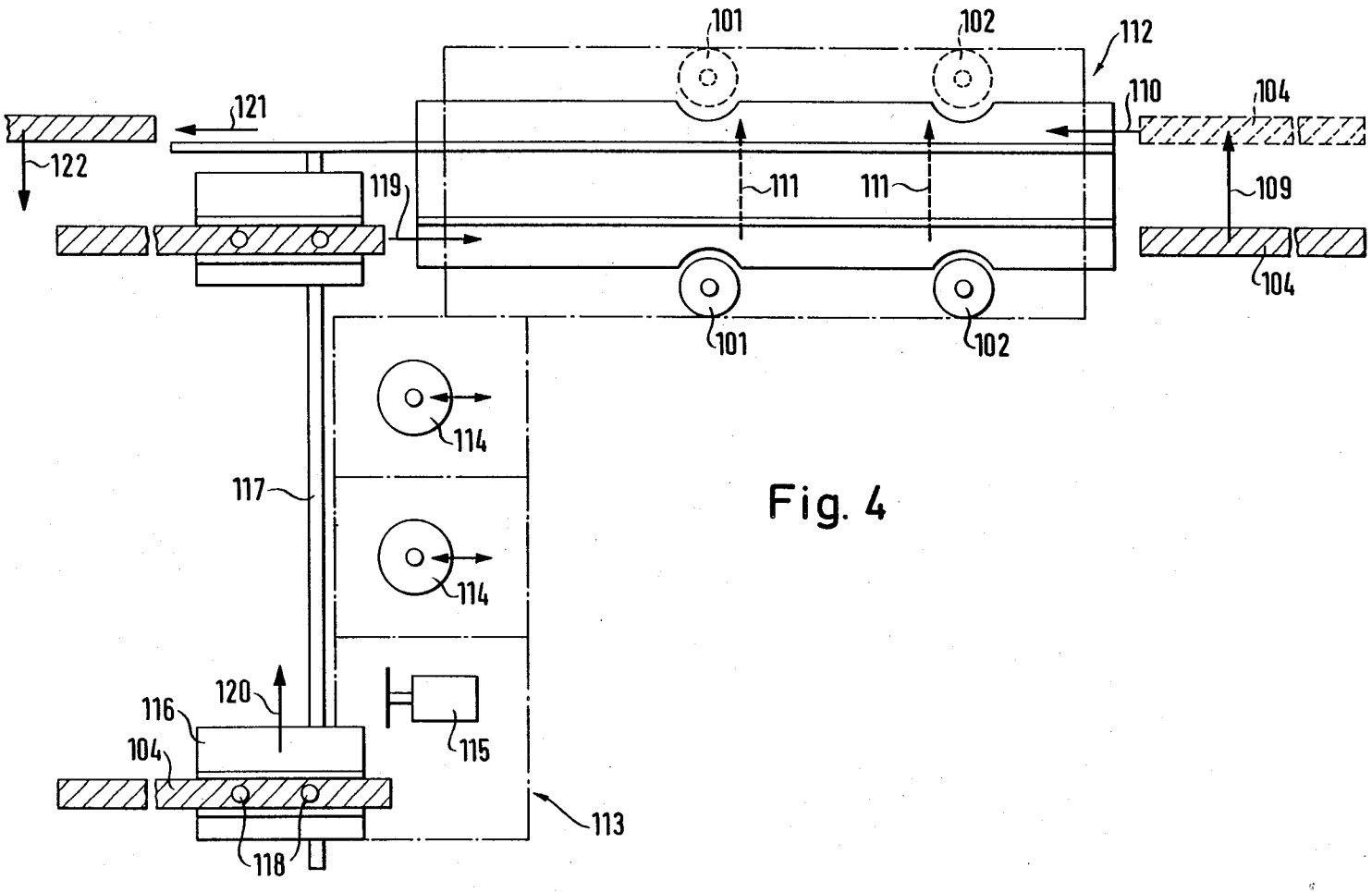
FIG. 4 is the lengthwise profiling apparatus of FIG. 1 with tenon-and-mortise cutting apparatus.
Figure 5:
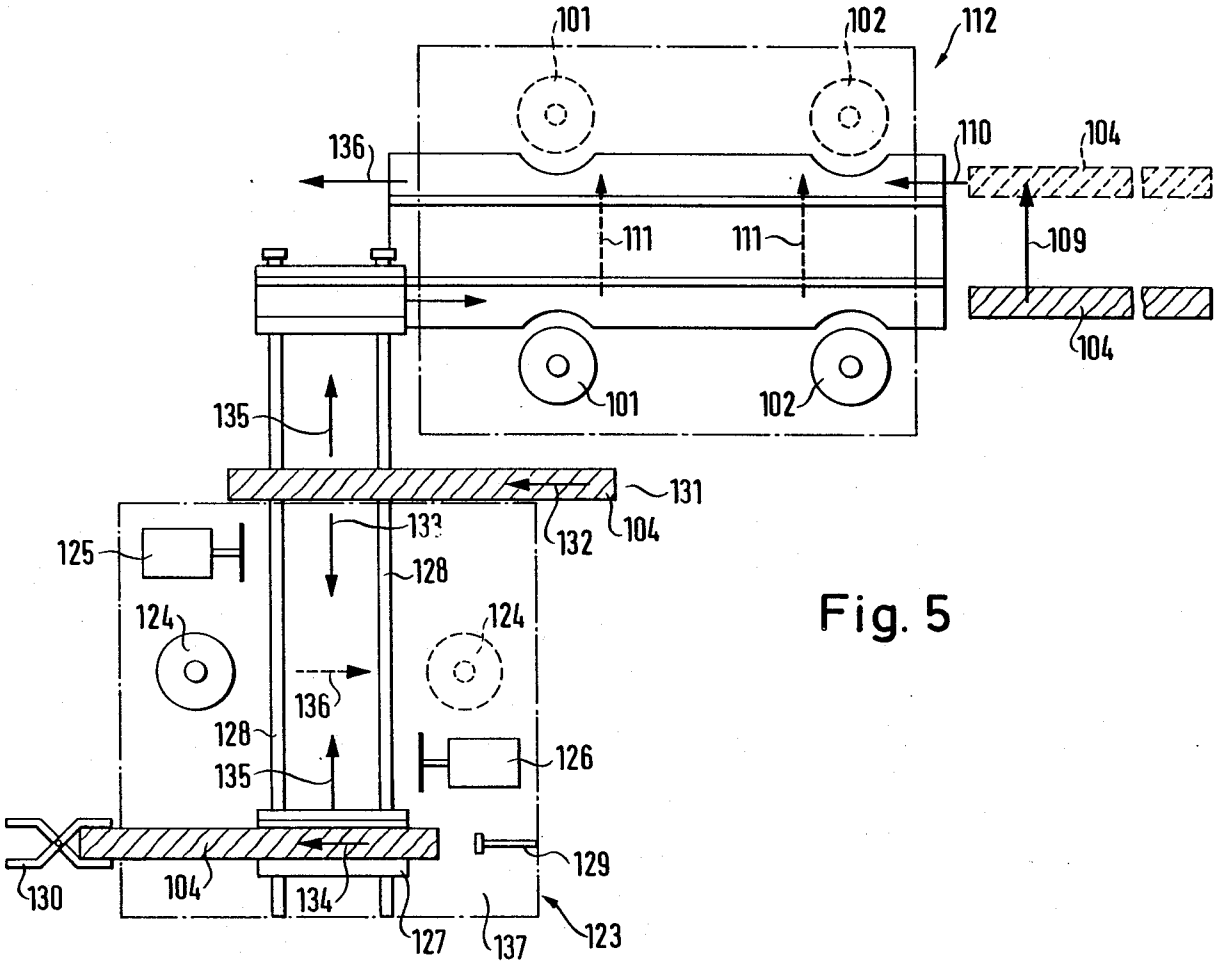
FIG. 5 is the lenghwise profiling apparatus of FIG. 1 with another tenon-and-mortising apparatus.

FIGS. 3 through 5 show how the above principle is applied to lengthwise profiling apparatus.

In the embodiment of FIG. 3, there are two lengthwise profiling spindles 101 and 102 each of which together with its power drive and other accesssories can be lowered below the surface of a work table 103. When lowered, the lengthwise profiling spindles 101 and 102 can be displaced underneath the work table 103 to assume the positions shown in solid and dashed lines.

The processing sides of the lengthwise profiling spindles 101 and 102 face each other in the two operational positions.

The outlined operator 105 feeds the window frame 104 to be processed in the direction of the arrow 106 into the lengthwise profiling apparatus and this frame is guided past a stop 107 and the lengthwise profiling spindles 101 and 102, being profiled in the process in the longitudinal direction. During this first lengthwise profiling procedure the two spindles 101 and 102 are in the lower position of the Figure and are indicated by solid lines.

Following the lengthwise profiling of the first longitudinal side, the window frame 104 is moved transversely in the direction of the ararow 109 into a second initial position from where it is fed back into the lengthwise profiling equipment in the direction of the aarow 110. Simultaneously the two spindles 101 and 102 are moved below the work table 103 in the direction of the aarrows into the position shown by the dashed lines, whereby now the second longitudinal side of the window frame 104 can be profiled lengthwise. For the purpose the window frame 104 is moved along a stop 108 through the apparatus, whereby the finished window frame can be received by the opeator 105.

FIG. 4 shows the linkage between the lengthwise profiling apparatus 112 of the invention and unit 113 for cutting tenons and mortises. This unit in the embodiment shown comprises two tenoning-and-mortising spindles 114 which are preceded by a length-cutting saw 115 and associated with a roller table 116. This roller table 116 can be displaced along a guide 117 and comprises clamps 118 to fasten the window frame to the roller table.

The window frame 104 is already provided with tenon and mortise at its end away from the tenoning-and-mortising spindles 114 and is moved through the roller table 116 in the direction of the arrow 120 first past the length-cutting saw 115 which cuts it to size. Then it is processed by the tenoning-and-mortising spindles 114. At the end position of the roller table 116, this frame is transferred at right angle in the direction of the aarrow 119 to the lengthwise profiling apparatus 112 through which it moves then in the described manner. It leaves the lengthwise profiling apparatus in the direction of the arrow 121 and thereupon it can be moved back to its initial position in a second plane in the direction of the arrow 122.

FIG. 5 shows an embodiment where a modified tenoning-and-mortising unit 123 precedes the lengthwise profiling apparatus 112. This unit consists of a single tenoning-and-mortising spindle 124 displaceable underneath the plane of the work table 137 or underneath the plane of a roller table 127 into a second position shown in dashed lines. A length-cutting saw 125 and 126 is associated resp. with each position of the tenoning-and-mortising spindle 124. The roller table 127 is displaceable along guides 128 and again comprises clamps for the window frame 114 to be processed.

Also conveying means to displce the window frame 104 and to control its length are provided for instance in the form of a pushrod 129 or a gripper 130. The design of this lengthwise profiling apparatus 112 corresponds to that of the other two embodiment modes. The window-frame 104 to be processed is fed in the direction of the arrow 132 at 131 into the woodworking machine and thereupon is made to move on in the direction of the arrow 133. Its end on the left in FIG. 5 is then cut to size by the length-cutting saw 125, and thereupon the frame it provided at that end with tenon and mortise by the tenoning-and-mortising spindle. Next the window frame is moved to the left in FIG. 5 in the direction of the arrow 134 until the predetermined length has been reached. Thereupon the roller table moves in the direction of the arrow 135 in the opposite direction whereby the right end in FIG. 5 of the window frame also is cut to size by the length-cutting saw 126. During this displacement he tenoning-and-mortising spindle 124 moves underneath the work table or roller table 127 to the right in the direction of the arrow 136 to assume the position shown in dashed lines in FIG. 5. As result the right end of the winddow frame 104 also is provided with tenon and mortise.

The window frame processed in this manner is then fed in the above described manner to the lengthwise profiling equipment 112 from which it exits again fully processed in the direction of the aarrow 136.

I claim:

1. A woodworking machine for tenon and mortise cutting and lengthwise profiling of a rectangular wooden workpiece, comprising:

(a) a table;

(b) a conveyor mounted on said table for advancing said workpiece;

(c) a roller table having a first side and a second side and first end and a second end mounted on said table perpendicular to said conveyor;

(d) means on said roller table for clamping said workpiece;

(e) means for tenoning and mortising said workpiece;

(f) means for lengthwise cutting said workpiece;

(g) means for lowering said means for tenoning and mortising and said means for lengthwise cutting below said table and said roller table;

(h) means for displacing said means for tenoning and mortising from a first position on said first side to a second position on said second side;

(i) means for advancing said workpiece from said first end to said second end past said first position;

(j) means for lengthwise adjustment of said workpiece in said means for clamping at said second end;

(k) means for advancing said lengthwise adjusted workpiece from said second end to said first end past said second position;

(l) means for lengthwise profiling said workpiece mounted on said table; and (m) means for transferring said workpiece from said first end to said means for lengthwise profiling.

2. The woodworking machine of claim 1, wherein said workpiece has a longitude and said first and second positions are located in a vertical plane parallel to said longitude.

3. The woodworking machine of claim 1, wherein said means for lengthwise cutting has means for displacement to said first and second positions.

4. The woodworking machine of claim 3, having a single means for lengthwise cutting displaceable jointly with said means for tenoning and mortising.

5. The woodworking machiine of claim 4, having guide rods of circular cross-section provided both for transverse displacement of said means for tenoning and mortising and also for its height adjustment.

6. The woodworking machine of claim 5, wherein said height adjusting guides of said means for tenoning and mortising are transversely displaceable jointly with said means for tenoning and mortising.

7. A woodworking machine for tenon and mortise cutting and lengthwise profiling of a rectangular wooden workpiece, comprising:

(a) a table;

(b) a conveyor mounted on said table for advancing said workpiece;

(c) a roller table having a first side and a second side and a first end and a second end mounted on said table perpendicular to said conveyor;

(d) means on said roller table for clamping said workpiece;

(e) means for tenoning and mortising said workpiece located at a first position on said first side and a second position on said second side;

(f) means for lengthwise cutting said workpiece located at a first position on said first side and a second position on said second side;

(g) means for lowering said means for tenoning and mortising below said table and said roller table;

(h) means for lowering said means for lengthwise cutting below said table and said roller table;

(i) means for advancing said workpiece from said first end to said second end past said first position;

(j) means for lengthwise adjustment of said workpiece in said means for clamping at said second end;

(k) means for advancing said lengthwise adjusted workpiece from said second end to said first end past said second position;

(l) means for lengthwise profiling said workpiece mounted on said table; and (m) means for transferring said workpiece from said first end to said means for lengthwise profiling.

8. The woodworking machine of claim 7, wherein said means for lowering said means for lengthwise cutting are pivots.

9. The woodworking machine of claim 8, wherein one pivot is a downward pivot and the other pivot is an upward pivot.

10. The woodworking machine of claim 1, wherein said means for lengthwise profiling comprise lengthwise profiling spindle means having means for lowering said spindle means below said table and means for displacing said spindle means from a first position for the lengthwise profiling of a first longiudinal side of said workpiece into a second position for the lengthwise profiling of a second longitudinal side of said workpiece, where, in order to process said second longitudinal side, said workpiece has means to pass the offset lengthwise profiling spindle means oppositely the previous direction of advance, the processing sides of said spindlel facing each other in said two positions.

11. The woodworking machine of claim 10, having a single lengthwise profiling spindle.

12. The woodworking machine of claim 10, having a plurality of lengthwise profiling spindles.

* * * * *